United States Patent [19]

Berkich

[11] Patent Number: 4,793,225

[45] Date of Patent: Dec. 27, 1988

[54] CLAMPING TOOL

[76] Inventor: Ronald Berkich, R.D. #1, Leola, Pa. 17540

[21] Appl. No.: 533,639

[22] Filed: Sep. 19, 1983

[51] Int. Cl.[4] ..... B25B 7/04

[52] U.S. Cl. ..... 81/356; 81/176

[58] Field of Search ..... 81/356, 165, 170, 174–176, 81/180 B, 184

[56] References Cited

U.S. PATENT DOCUMENTS

| | | | |
|---|---|---|---|
| 132,057 | 10/1872 | Cooper et al. | 81/170 X |
| 599,379 | 2/1898 | Billings | 81/176 X |
| 1,735,011 | 11/1929 | Plante | 81/356 |
| 2,076,462 | 4/1937 | Horechney | 81/180 B |

*Primary Examiner*—James G. Smith

*Attorney, Agent, or Firm*—Nixon & Vanderhye

[57] ABSTRACT

A hand tool is provided which can be used as an adjustable wrench, adjustable joint pliers, vise grip, and clamp. A first jaw is mounted for linearly reciprocal movement with respect to a body, with a second jaw affixed to the body and cooperating with the first jaw. First and second structures are provided for adjusting the position of the first jaw with respect to the body, the first structure including an elongated bar having a linear gear thereon and a worm gear rotatable about a pin and mounted by the body. The second structure comprises a hand engageable lever which collapses, or places in-line, a locking lever system. The locking lever system is operatively connected to the pin mounting the worm gear. Jaw extensions are provided for extending the length of the jaws without interferring with movement of the first jaw with respect to the body. An extension bar also is provided for extending the length of the elongated bar, and thus the possible maximum spacing between the first and second jaws.

13 Claims, 2 Drawing Sheets

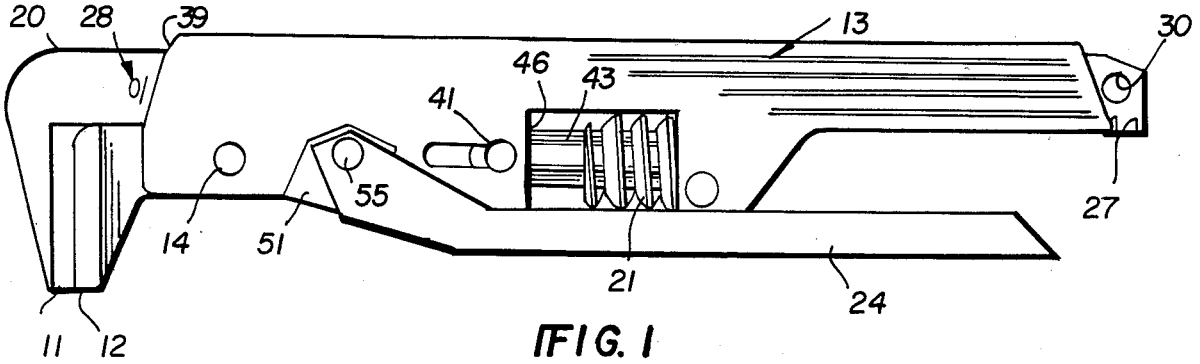
FIG. 1
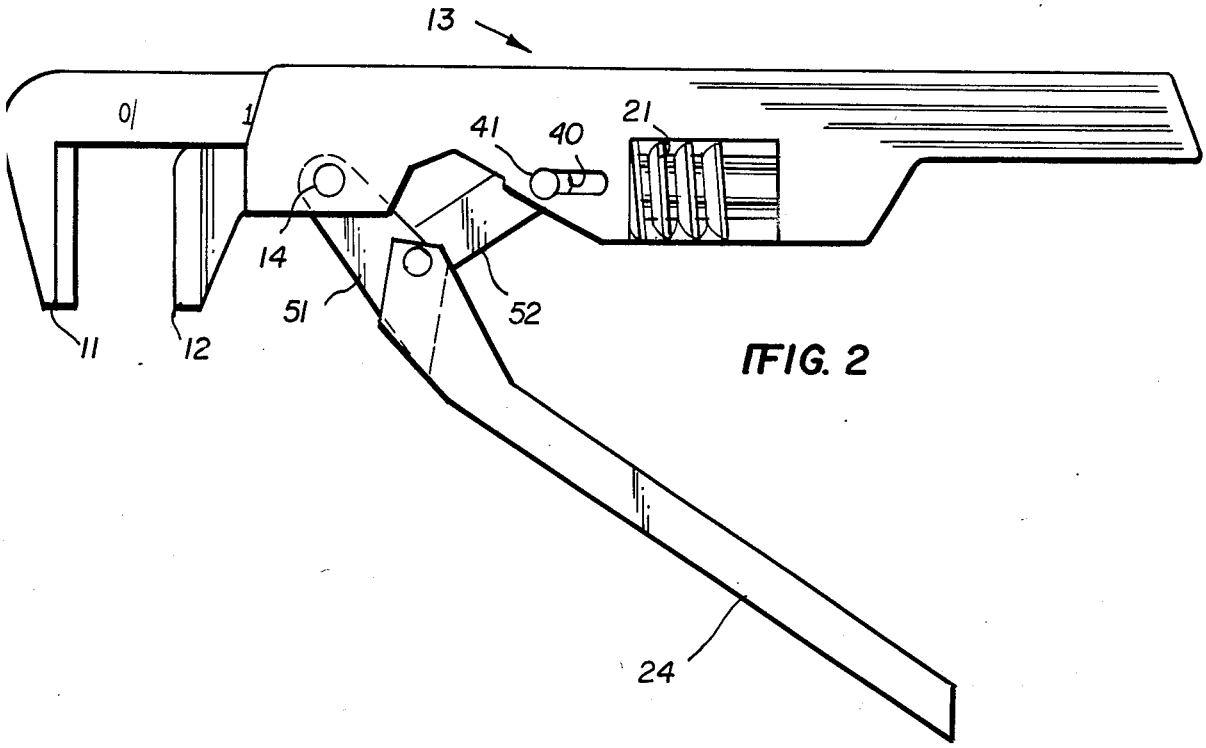
FIG. 2
FIG. 3
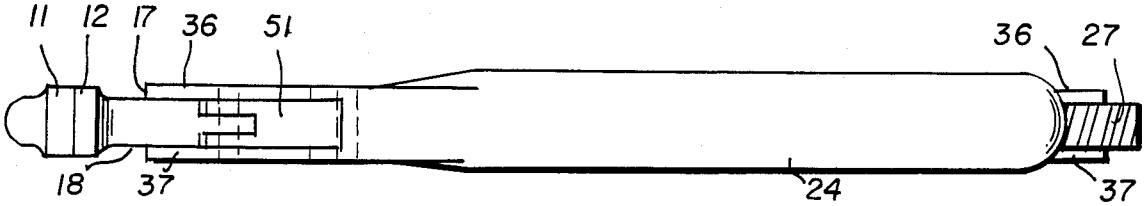

CLAMPING TOOL

BACKGROUND AND SUMMARY OF THE INVENTION

It is desirable to provide a multi-purpose hand tool, one which will perform substantially all the functions of an infinitely adjustable wrench, adjustable joint pliers, vise grip, and clamp, without drawbacks associated therewith. A hand tool according to the present invention is capable of performing the functions of the above-mentioned tools, and in fact in a more effective manner. For instance the tool according to the present invention is capable of clamping objects in a parallel manner using the full length of the jaws, unlike vise grips, and can reach into places not accessible with vise grips and may be adjusted with one hand, unlike vise grips. Despite the great adaptability of the tool according to the invention and its enhanced functionality vis-a-vis conventional vise grips, it is formed of a relatively few, easy to construct parts, is simply operated, and has components that are easily extended in order to accommodate work pieces of various sizes.

The basic features of the hand tool according to the present invention comprise: A first jaw. A body. A second jaw affixedly attached to said body. And, means for mounting said first jaw to said body for linear reciprocal movement with respect to said body, and operative cooperation with said second jaw. The mounting means includes means for adjusting the position of the first jaw with respect to the body, and second means, including components distinct from the first means, for adjusting the position of said first jaw with respect to said body.

According to one aspect of the present invention, the second means comprising a hand engageable lever; a lever locking system including a lever operatively attached to the first jaw and a lever operatively attached to the body; and means for operatively inter-connecting the hand engageable lever to the locking lever system to effect movement thereof, and thereby movement of the first jaw with respect to the body.

According to another aspect of the present invention, the first means for adjusting the position of the first jaw with respect to the body comprises: an elongated bar attached to the first jaw, and including a linear gear portion thereof, the bar being elongated in a dimension defining the linear path of reciprocation of the first jaw with respect to the body, and the bar being received by the body for linear reciprocation; a worm gear rotatable about a pin, the pin operatively mounted by the body, and the pin extending parallel to the dimension of elongation of the bar; the worm cooperatively engaging the linear gear of the bar; and the body providing access to the worm to allow hand adjustment thereof.

According to yet another aspect of the present invention, extension means are provided operatively attached to the first and second jaws for extending the operative lengths thereof while not interferring with movement of the jaws with respect to each other.

It is the primary object of the present invention to provide a versatile, yet simple to construct and operate, hand tool. This and other objects of the invention will become clear from an inspection of the detailed description of the invention, and from the appended claims.

BRIEF DESCRIPTION OF THE DRAWINGS

FIG. 1 a side view of an exemplary hand tool according to the present invention;

FIG. 2 is a view like that of FIG. 1 but showing the hand engageable lever thereof in a position in which it has effected movement of the jaws away from each other;

FIG. 3 is a bottom plan view of the tool of FIG. 1;

DETAILED DESCRIPTION OF THE DRAWINGS

Figure 4:
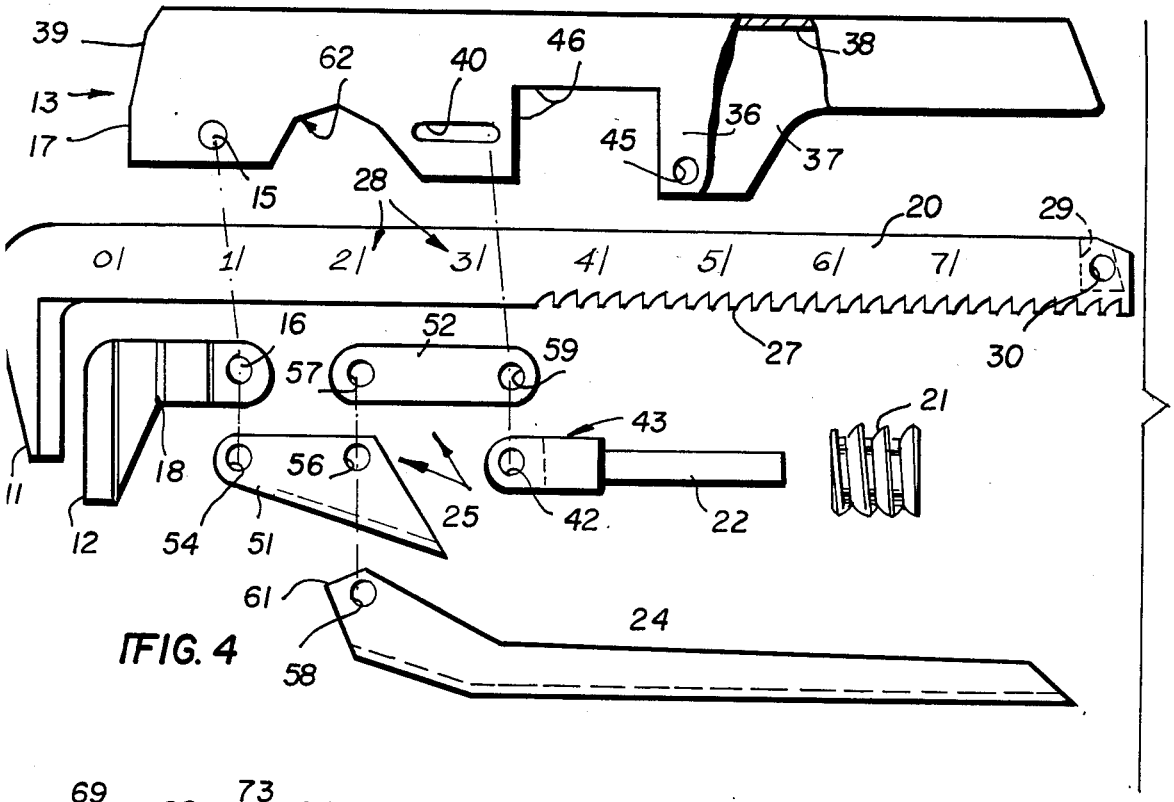
FIG. 4 is an exploded side view of the tool of FIG. 1, with portions cut away for clarity of illustration.

An exemplary hand tool according to the present invention is shown generally by reference numeral 10 in the drawings. The major components of the hand tool 10 comprise a first jaw 11, a second jaw 12, and a body 13. The second jaw 12 is affixed to the body 13, as by a rivet 14 (see FIGS. 1 and 2), which extends through an opening 15 in body 13, and a corresponding opening 16 in second jaw 12 (see FIG. 4), and by abutment surfaces 17, 18 on the body 13 and second jaw 12, respectively by spot welding.

Means are provided for mounting the jaw 11 for linear reciprocal movement with respect to the body 13 and jaw 12, and so that it is in cooperative association with the jaw 12, as seen in FIGS. 1, 2, 3, and 5. Such mounting means include first means—which include elongated bar 20, worm gear 21, and pin 22—for adjusting the position of the jaw 11 with respect to the body 13; and second means for adjusting the position of the first jaw 11 with respect to the body 13. The second means includes at east some components that are not in common with the first adjustment means, and in the exemplary embodiment illustrated in the drawings include a hand engageable lever 24, and a locking lever system shown generally by reference numeral 25 (see FIGS. 2 and 4).

Figure 6:
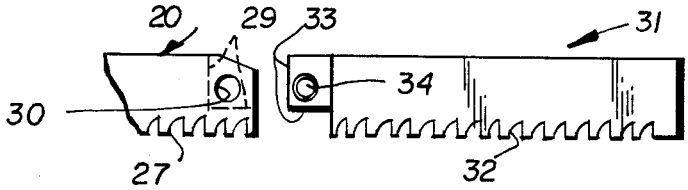
FIG. 6 is a side view of a bar extension according to the invention, shown in cooperation with an end portion of the bar of the hand tool of FIG. 1.

The bar 20 is elongated in a dimension generally perpendicular to the operative face of the jaw 11, and includes a linear gear 27, indicia 28 (which preferably are numerical indicia spaced predetermined distances apart), and end wall portions 29 and opening 30 for connection of the bar 20 to a bar extension 31 (see FIG. 6). The bar extension 31 also includes a linear gear 32 as well as wall portion 33 for engaging the wall portions 29, and a pin 34 for receipt by the opening 30. The bar 20 is mounted for reciprocation within the body 13, the body 13—as indicated by the cut-away portion in FIG. 4—having a first side web 36 spaced from a second side web 37, with an interconnecting web 38, and an open face opposite the web 38.

The surface means 39 on the body 13 cooperates with the indicia 28 to indicate the spacing of the work-engaging surface of the first jaw 11 from the work-engaging surface of the second jaw 12. An elongated slot 40 is formed adjacent the open face of the body 13, and is elongated so that it is essentially parallel to the top web 38, and bar 20.

The pin 22 is mounted by the body 13 for reciprocal linear movement so that the pin 22 stays essentially parallel to the bar 20, with the worm gear 21 in engagement with the linear gear 27. This is accomplished by providing an abutment (e.g. pin) 41 which is received within elongated opening 40 and the opening 42 (see FIG. 4) in the enlarged end 43 of pin 22. At the opposite end of pin 22 from the enlarged end 43 thereof, another abutment (e.g. pin) 44 is received within opening 45 (see FIG. 4) of the body 13, and supports the bottom of the pin 22. If desired, a cotter pin, or the like, may be provided extending through the pin 22 to hold the worm gear 21 on the pin 22 between it and the enlarged end 43 so that when the pin 22 is reciprocated it is ensured that the gear 21 is also reciprocated. The worm gear 21 is accessible to an operator's hand since it is disposed within the cut-out 46 formed in the body 13, the cut-out having a dimension parallel to the dimension of elongation of the bar 20 that is greater than the dimension of the worm gear 21 in that dimension Preferably the locking lever system 25 consists of a first locking lever 51 and a second locking lever 52. As can be seen most clearly with respect to FIGS. 2 and 4, the lever 51 is pivotally mounted at one end thereof by a pin 14 extending through an opening 54 therein (and openings 15 and 16 in the members 13, 12 respectively), and is pivotally mounted at another portion thereof to the second lever 52. This pivotal mount is preferably accomplished by providing a pin 55 which passes through the openings 56, 57 in the levers 51, 52, and then an opening 58 in the hand engageable lever 24. The lever 52 is pivotally mounted at the end thereof opposite the opening 57 to the first jaw 11, and this is preferably accomplished by providing the abutment pin 41 extending through opening 59 therein, and opening 42 in the yoke-shaped enlarged end 43 of pin 22.

The hand engageable lever 24 is engageable by the operator to move the lever locking system 25 between an in-line position (FIG. 1) wherein the jaws 11, 12 are spaced an amount determined by the adjustment of the worm gear 21 engaging the linear gear 27, and a collapsed position (FIG. 2) in which the jaws 11, 12 are further apart than in the lever in-line position. In order to facilitate movement of the lever 24 between the positions illustrated in FIGS. 1 and 2, abutments means 61, 62, respectively are provided on the lever 24 and the body 13.

Figure 5:
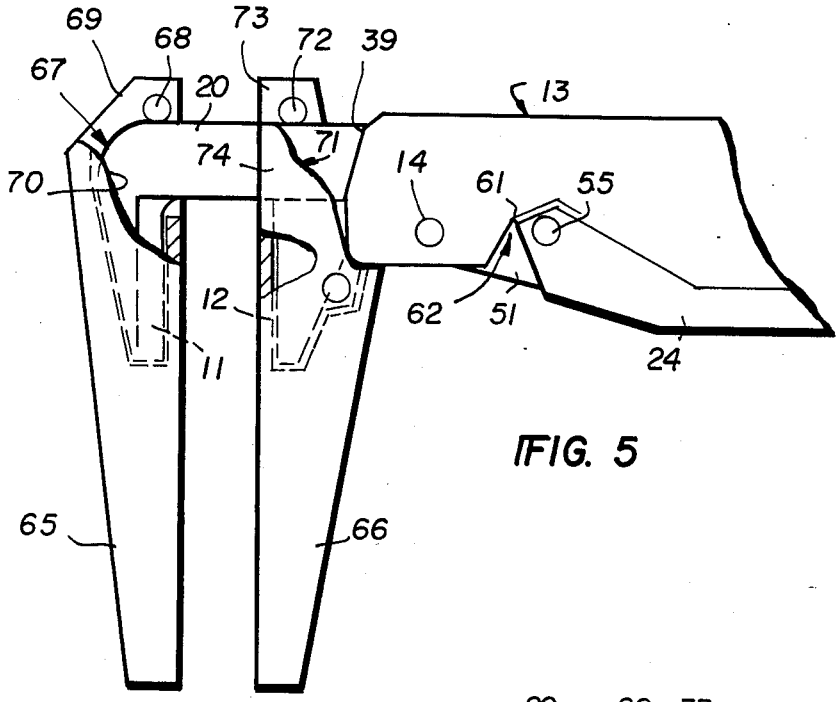
FIG. 5 is a detail side view of the jaws of the tool of FIG. 1 showing them in operative association with jaw extensions, and with portions cut away for clarity of illustration.

In some circumstances work pieces must be engaged by the jaws 11, 12, that are larger than the work-surfaces of the jaws 11, 12 as illustrated in FIGS. 1 through 4. In these circumstances, the jaw extensions 65, 66 illustrated in FIG. 5 are utilized. These jaw extensions do not interfere with the movement of the jaws 11, 12 with respect to each other, but merely provide a larger working area thereof.

The jaw extension 65 includes a body portion having an open-topped recess 67, the recess having a shape generally corresponding to the shape of the first jaw 11. Once the jaw 11 has been inserted into the recess 67, a pin 68 is passed through cooperating openings in side portions 69, 70 of the extension 65, to hold the extension 65 in place. For the extension 66 similar components are utilized, including an open-topped recess 71, and a pin 72 extending between side plates 73, 74.

OPERATION

In the utilization of the hand tool 10 according to the present invention as an adjustable wrench, for example, the user would hold the body 13 in one hand, with the lever 24 in the position illustrated in FIG. 1, and would rotate the worm gear 21 about the pin 22 with that same hand. The worm 21 engaging the linear gear 27 would cause the bar 20 to reciprocate outwardly from the body 13 so that the first jaw 11 moved away from the second jaw 12 until the predetermined desired spacing was reached, and then the jaws 11, 12 would be moved into operative engagement with the work.

In utilizing the device 10 as a vise grips, for example, the same basic operation would be effected as described above, except that after the desired spacing between the jaws 11 and 12 was reached, the lever would be moved downwardly (again one-hand operation would be possible) about the pivot point defined by pin 55, to collapse the levers 51, 52 so that the position illustrated in FIG. 2 was assumed.

The engagement between the abutment means 61, 62 would facilitate this movement. As this movement was effected the pivot pin—abutment 41 extending through the member 43 and lever 52 would move to the left in the drawings, guided in slot 40, until the pin 41 abutted the left end of the slot 40 and/or the gear 21 abutted the left side of the cut-out 46. Since the worm 21 and linear gear 27 are in engagement, and since the worm 21 is being moved leftwardly in the figures, the jaw 11 would be moved so that it was further spaced from the jaw 12 than it was originally. To return the jaws 11, 12 to the work-clamping position, it is only necessary to grasp the lever 24 and body 13 and squeeze, so that the lever returns to the position illustrated in FIG. 1.

While two exemplary uses of the tool 10 according to the invention have been described above, it will be apparent that many other uses thereof are also appropriate. For instance, the tool 10 can be used instead of a conventional adjustable pliers, and instead of a conventional clamp.

It will thus be seen that according to the present invention a simple to use and easy to construct hand tool has been provided, which tool is exceptionally versatile, and in fact can perform the functions of at least four conventional separate hand tools. While the invention has been herein shown and described in what presently conceived to be the most preferred and practical embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A hand tool comprising:

a first jaw;

a body;

a second jaw affixedly attached to said body; and means for mounting said first jaw to said body for linear reciprocal movement with respect to said body, and operative cooperation with said second jaw;

said mounting means including first means for adjusting the position of said first jaw with respect to said body; and second means, including components distinct from said first means, for adjusting the position of said first jaw with respect to said body; said first means comprising an elongated bar attached to said first jaw, and including a linear gear portion thereof, said bar being elongated in a dimension defining the linear path of reciprocation of said first jaw with respect to said body, and said bar being received by said body for linear reciprocation; a worm gear rotatable about a pin which passes completely through said worm, said pin operatively mounted by said body, and said pin extending parallel to the dimension of elongation of said bar and an enlarged end; said worm cooperatively engaging said linear gear of said bar; and said second means comprising: a member connected to said pin enlarged end and for reciprocating said pin; and means for mounting said pin for linear reciprocation with respect to said body in a linear path along the axis of said pin, linear reciprocation of said pin effecting linear reciprocation of said worm gear and thereby linear movement of said first jaw with respect to said body.

2. A hand tool as recited in claim 1 wherein said second means comprises: a hand engageable lever; a lever locking system including a lever operatively attached to said first jaw and a lever operatively attached to said body; and means for operatively connecting said hand engageable lever to said locking lever system to effect movement thereof, and thereby movement of said first jaw with respect to said body.

3. A tool as recited in claim 2 wherein said lever of said locking lever system operatively attached to said first jaw is operatively attached to said first jaw through said first adjustment means.

4. A tool as recited in claim 2 wherein one of aid levers of said locking lever system is said member operatively connected to said pin to effect linear reciprocation thereof.

5. A tool as recited in claim 2 wherein said means for mounting said pin for linear reciprocal movement comprises: an elongated slot formed in said body, and a first abutment member extending outwardly from said pin and operatively engaging said slot; and a second abutment member for guiding reciprocation of said pin at an end thereof opposite said abutment member.

6. A tool as recited in claim 2 wherein said locking lever system consists of first and second levers, said first lever being pivotally connected at one end thereof to said body, and pivotally connected at another portion thereof to said second lever, and said second lever being operatively pivotally connected at another portion thereof to said first jaw.

7. A tool as recited in claim 6 wherein said means for operatively attaching said hand engageable lever to said locking lever system provides a common pivot connection between said first and second levers and said hand engageable lever.

8. A tool as recited in claim 7 further comprising abutment means formed on said hand engageable lever and said body for facilitating movement of said hand engageable lever so that it collapses said locking lever system, so that said first jaw will move away from said second jaw.

9. A tool as recited in claim 6 further comprising extension means operatively attached to said first and second jaws for extending the operative lengths thereof while not interferring with movement of said jaws with respect to each other; said extension means comprising, for each jaw: an extension member having first and second spaced side plates, with a recess receiving a jaw of said tool disposed between said side plates; and a pin extending between said side plates and for engaging the jaw corresponding thereto, for holding said jaw in said recess.

10. A hand tool comprising:

a first jaw;

a body;

a second jaw affixedly attached to said body; and means for mounting said first jaw to said body for linear reciprocal movement with respect to said body, and operative cooperation with said second jaw; said mounting means including first means for adjusting the position of said first jaw with respect to said body; said first means for adjusting the position of said first jaw with respect to said body comprising: an elongated bar attached to said first jaw, and including a linear gear portion thereof, said bar being elongated in a dimension defining the linear path of reciprocation of said first jaw with respect to said body, and said bar being received by said body for linear reciprocation; a worm gear rotatable about a pin, said pin operatively mounted by said body, and said pin extending parallel to the dimension of elongation of said bar; said worm cooperatively engaging said linear gear of bar; and said body providing access to said worm to allow hand adjustment thereof;

means for mounting said pin for linear reciprocation with respect to said body in a linear path along the axis of said pin, linear reciprocation of said pin effecting linear reciprocation of said gear and thereby linear movement of said first jaw with respect to said body, comprising an elongated slot formed in said body, and a first abutment member extending outwardly from said pin and operatively engaging said slot; and a second abutment member for guiding reciprocation of said pin at an end thereof opposite said abutment member.

11. A hand tool comprising:

a first jaw;

a body;

a second jaw affixedly attached to said body;

means for mounting said first jaw to said body for linear reciprocal movement with respect to said body, and operative cooperation with said second jaw; said mounting means including first means for adjusting the position of said first jaw with respect to said body; said first means for adjusting the position of said first jaw with respect to said body comprising: an elongated bar attached to said first jaw, and including a linear gear portion thereof, said bar being elongated in a dimension defining the linear path of reciprocation of said first jaw with respect to said body, and said bar being received by said body for linear reciprocation; a worm gear rotatable about a pin, said pin operatively mounted by said body, and said pin extending parallel to the dimension of elongation of said bar; said worm cooperatively engaging said linear gear of said bar; and said body providing access to said worm to allow hand adjustment thereof;

an extension bar having a linear gear; and means for operatively connecting said extension bar to said elongated bar to extend the length thereof, and thereby effectively extend the amount said first jaw can be linearly reciprocated with respect to said body.

12. A hand tool comprising:

a first jaw;

a body;

a second jaw affixedly attached to said body; and means for mounting said first jaw to said body for linear reciprocal movement with respect to said body, and operative cooperation with said second jaw;

said mounting means including first means for adjusting the position of said first jaw with respect to said body; and second means, including components distinct from said first means, for adjusting the position of said first jaw with respect to said body;

said second means comprising: a hand engageable lever; first and second levers, said first lever being pivotally connected at one end thereof to said body, and pivotally connected at another portion thereof to said second lever, and said second lever being operatively pivotally connected at another portion thereof to said first jaw; said hand engageable lever connected to said first and second levers at the pivotal connection between said first and second levers so that movement of said hand engageable lever effects movement of said first and second levers between a substantially in-line position, and an angled position, to thereby effect relative movement of said first jaw with respect to said body.

13. A tool as recited in claim 12 wherein said second lever is operatively attached to said first jaw through said first adjustment means.

* * * * *